US012078365B2

(12) United States Patent
Sun et al.

(10) Patent No.: US 12,078,365 B2
(45) Date of Patent: Sep. 3, 2024

(54) OUTDOOR UNIT OF AIRCONDITIONER

(71) Applicant: SAMSUNG ELECTRONICS CO., LTD., Suwon-si (KR)

(72) Inventors: Woong Sun, Suwon-si (KR); Jeonguk Koh, Suwon-si (KR); Jaechan Park, Suwon-si (KR); Kwangnam Shin, Suwon-si (KR); Seungjin Yun, Suwon-si (KR); Changsoo Lim, Suwon-si (KR); Keunjeong Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 9 days.

(21) Appl. No.: 17/991,980

(22) Filed: Nov. 22, 2022

(65) Prior Publication Data

US 2023/0243524 A1 Aug. 3, 2023

Related U.S. Application Data

(63) Continuation of application No. PCT/KR2022/017630, filed on Nov. 10, 2022.

(30) Foreign Application Priority Data

Jan. 28, 2022 (KR) ..... 10-2022-0013550

(51) Int. Cl.
*F24F 1/54* (2011.01)

(52) U.S. Cl.
CPC ..... *F24F 1/54* (2013.01)

(58) Field of Classification Search
CPC ..... F24F 1/54; F24F 1/46; F24F 1/38
(Continued)

(56) References Cited

U.S. PATENT DOCUMENTS 10,429,089 B2 10/2019 Jeon
2022/0082271 A1 3/2022 Watanabe

FOREIGN PATENT DOCUMENTS

CN 112413747 A 2/2021
EA 3 208 548 A1 8/2017
(Continued)

OTHER PUBLICATIONS

International Search Report dated Feb. 22, 2023 in International Patent Application No. PCT/KR2022/017630.
(Continued)

*Primary Examiner* — Steve S Tanenbaum
(74) *Attorney, Agent, or Firm* — STAAS & HALSEY LLP

(57) ABSTRACT

An outdoor unit of an air conditioner includes a housing, a fan inside the housing and configured to cause air to flow and a machine room inside the housing at one side of the fan. A first partition inside the housing includes an inlet hole through which air flow from the fan enters the machine room. A second partition inside the housing, between the fan and the machine room, includes an outlet hole through which air in the machine room is sucked toward the fan. A fan guard is in front of the fan and includes an opening portion on one side of the fan guard that is positioned toward the first partition such that the air flow from the fan moves toward the machine room. A front cover, in front of the first partition, is configured to guide air having passed through the opening portion of the fan guide to the inlet hole of the first partition.

20 Claims, 14 Drawing Sheets

(58) Field of Classification Search
USPC ..... 62/259.1
See application file for complete search history.

(56) References Cited

FOREIGN PATENT DOCUMENTS

| | | | | |
|---|---|---|---|---|
| EP | 1 862 743 | A1 | | 12/2007 |
| EP | 3 764 006 | A1 | | 1/2021 |
| JP | 2015-40679 | | | 3/2015 |
| JP | 2016-80242 | | | 5/2016 |
| KR | 10-2002-0048701 | | | 6/2002 |
| KR | 10-2010-0065988 | | | 6/2010 |
| KR | 2010065988 | A | * | 6/2010 |
| KR | 10-2015-0084371 | | | 7/2015 |
| KR | 10-2020-0043847 | | | 4/2020 |
| KR | 10-2170829 | B1 | | 10/2020 |
| WO | WO 2020/178906 | A1 | | 9/2020 |

OTHER PUBLICATIONS

PCT/ISR/237 dated Feb. 22, 2023 in International Patent Application No. PCT/KR2022/017630.

* cited by examiner

OUTDOOR UNIT OF AIRCONDITIONER

CROSS-REFERENCE TO RELATED APPLICATION

This application is a continuation application, under 35 U.S.C. § 111(a), of International Patent Application No. PCT/KR2022/017630, filed on Nov. 10, 2022, which is based on and claims priority under 35 U.S.C. § 119 to Korean Patent Application No. 10-2022-0013550, filed on Jan. 28, 2022 in the Korean Intellectual Property Office, the disclosures of which are incorporated by reference herein in its their entirety.

BACKGROUND

1. Field

The disclosure relates to an outdoor unit of an air conditioner having an improved flow path.

2. Description of the Related Art

In general, an air conditioner is an apparatus including a cooling cycle, and there is a split type air conditioner including an indoor unit that is placed in an indoor space and an outdoor unit that is placed in an outdoor space.

An outdoor unit of an air conditioner includes an outdoor heat exchanger for performing heat exchange with outside air, a compressor for compressing a refrigerant, an expansion valve unit for decompressing the refrigerant, and a fan for forming a flow of air. Also, the outdoor unit of the air conditioner includes a housing for accommodating the outdoor heat exchanger, the expansion valve unit, the compressor, and the fan.

A machine room is partitioned and formed in one side of the housing of the outdoor unit of the air conditioner, and the compressor, a control box, etc. are accommodated in the machine room.

In the housing, a hole for cooling the machine room is formed such that outside air directly communicates with the machine room through a flow of air formed by the fan.

However, in the case in which the outdoor unit having the structure for cooling the machine room is installed to be in close contact with a wall, there may be difficulties in causing air to flow through the machine room.

SUMMARY

Accordingly, one embodiment is directed to an outdoor unit of an air conditioner, the outdoor unit including: a housing; a fan inside the housing and configured to cause air to flow; a machine room inside the housing at one side of the fan; a first partition inside the housing in front of the machine room, the first partition including an inlet hole through which air flow from the fan enters the machine room; a second partition inside the housing between the fan and the machine room, the second partition including an outlet hole through which air in the machine room is sucked toward the fan; a fan guard in front of the fan, the fan guard including an opening portion on one side of the fan guard that is positioned toward the first partition such that the air flow from the fan moves toward the machine room; and a front cover in front of the first partition and configured to guide air having passed through the opening portion of the fan guide to the inlet hole of the first partition.

Another embodiment is directed to the outdoor unit, wherein the front cover is aligned with the fan guard beside the fan guard, in front of the machine room.

Yet another embodiment is directed to the outdoor unit, further including: a heat exchanger inside the housing and configured to perform heat exchange with outside air; so that: air sucked into the fan passes through the heat exchanger and heat exchanged air is discharged along a front direction of the fan guard, via a main flow path; and air from the fan flows in a lateral direction through the opening portion of the fan guard to cool the machine room and return to the fan via a circulation flow path.

Yet another embodiment is directed to the outdoor unit, wherein the front cover is spaced from a front surface of the first partition to provide a flow space between the front cover and the first partition, thereby forming a portion of the circulation flow path.

Yet another embodiment is directed to the outdoor unit, wherein a first end corresponding to a front side of the second partition is connected with the first partition and a second end corresponding to a rear side of the second partition is connected with the heat exchanger to separate the machine room from a fan room in which the fan is accommodated.

Yet another embodiment is directed to the outdoor unit, wherein the housing includes: a side plate configured to cover a lateral side of the machine room and prevent outside air from entering the machine room; and a rear plate configured to cover a rear side of the machine room and prevent outside air from entering the machine room, the rear plate connected with the side plate.

Yet another embodiment is directed to the outdoor unit, further including a support frame aligned with the first partition beside the first partition, behind the fan guard, and configured to maintain a position of the fan guard.

Yet another embodiment is directed to the outdoor unit, wherein the front cover includes a guard accommodating portion extending toward the fan guard and configured to be slidable and insertable into an inner side of the fan guard through the opening portion.

Yet another embodiment is directed to the outdoor unit wherein the front cover further includes a frame coupling portion extending outward from the guard accommodating portion and coupleable with the support frame.

Yet another embodiment is directed to the outdoor unit wherein the fan guard includes a fixing leg protruding from a rear surface of the fan guard in a rear direction and configured to be insertable in the support frame.

Yet another embodiment is directed to the outdoor unit, further including a guide rack coupleable with the first partition and configured to maintain the front cover inserted in an inner side of the fan guard by sliding from a side of the fan guard.

Yet another embodiment is directed to the outdoor unit, wherein the inlet hole is formed at a lower height than the outlet hole.

Yet another embodiment is directed to the outdoor unit, wherein the inlet hole is positioned to a side of a center of the fan, and the outlet hole is positioned behind the center of the fan.

Yet another embodiment is directed to the outdoor unit, wherein the machine room is cooled by air flow from the fan that enters the machine room and air, which cooled the machine room, is sucked into the fan.

Yet another embodiment is directed to the outdoor unit, wherein the front cover includes a polypropylene material.

Yet another embodiment is directed to an outdoor unit of an air conditioner, that includes: a housing including a base plate; a heat exchanger mounted on the base plate; a fan mounted on the base plate and configured to cause air to flow; a machine room formed to one side of the fan; a first partition coupled with the base plate and configured to cover a front side of the machine room and forming a partition for the machine room; a second partition positioned between the machine room and the fan, wherein a first end corresponding to a front side of the second partition is connected with the first partition and a second end corresponding to a rear end of the second partition is connected with the heat exchanger to form a partition for the machine room; a fan guard positioned in front of the fan and covering the fan; and a front cover positioned in front of the first partition, aligned with the fan guard beside the fan guard, and including a guard accommodating portion extending toward the fan guard configured to be inserted into a side of the fan guard.

The outdoor unit of the air conditioner may further include a support frame coupled with the fan guard and the guard accommodating portion, positioned behind the fan guard to fix a position of the fan guard, and aligned with the first partition beside the first partition.

The machine room may be cooled by air discharged from the fan, and air, which cooled the machine room, may be sucked into the fan.

An outdoor unit of an air conditioner, according to another embodiment of the disclosure, includes: a housing; a fan installed inside the housing; a heat exchanger installed inside the housing; a machine room formed to one side of the fan; a first partition positioned in front of the machine room; a fan guard positioned in front of the fan; a front cover aligned with the fan guard beside the fan guard, in front of the first partition; and a circulation flow path along which air discharged from the fan flows in a lateral direction of the fan guard to enter the machine room from a space formed between the front cover and the first partition, cools the machine room, and is sucked into the fan in front of the heat exchanger.

The fan guard may include an opening portion formed toward the front cover.

Additional embodiments of the disclosure will be set forth in part in the description which follows and, in part, will be obvious from the description, or will be apparent from the disclosure.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
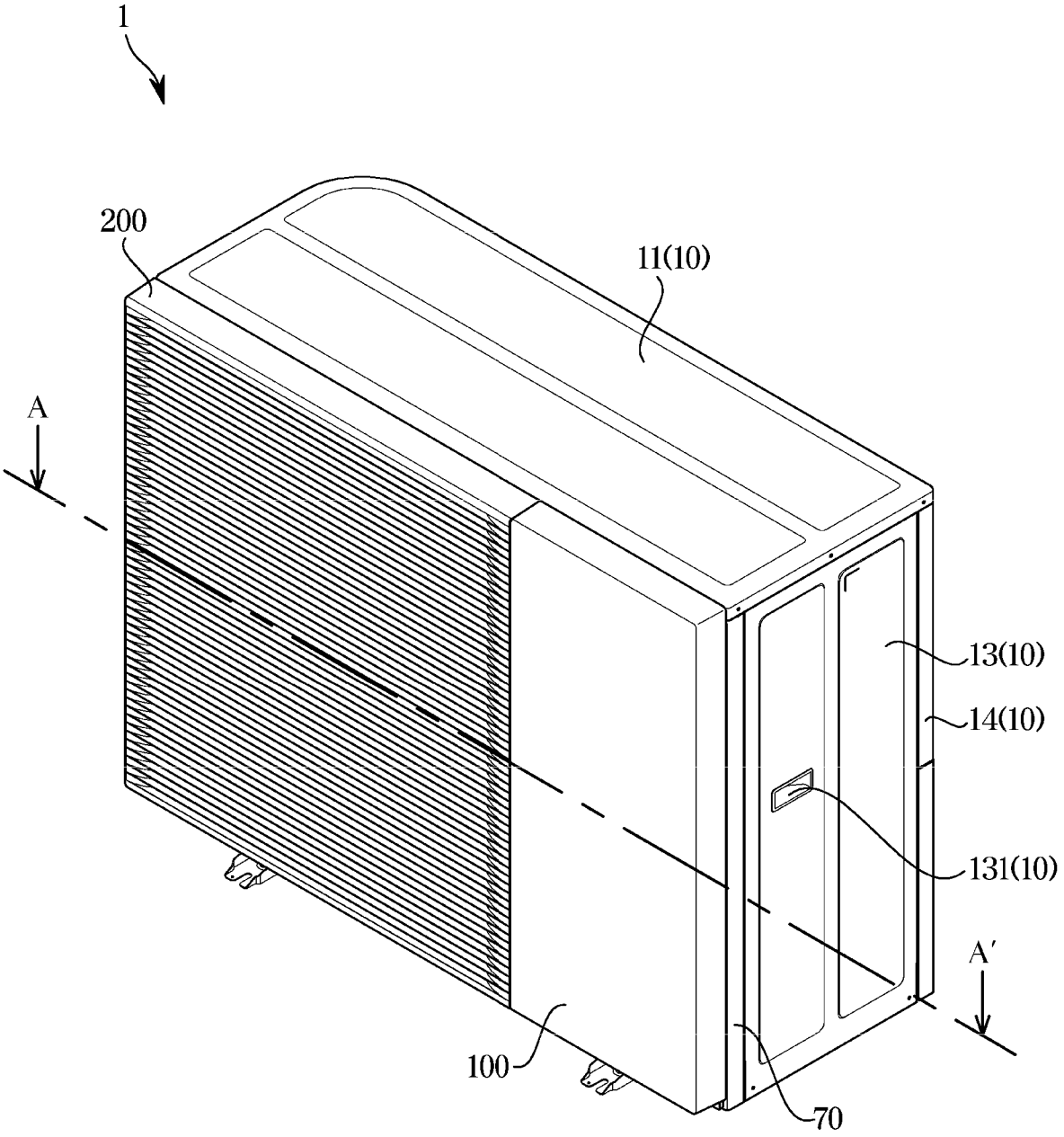
FIG. 1 is a perspective view of an outdoor unit of an air conditioner according to an embodiment of the disclosure.

Configurations illustrated in the embodiments and the drawings described in the present specification are only some embodiments of the disclosure, and thus it is to be understood that various modified examples, which may replace the embodiments and the drawings described in the present specification, are possible.

Also, like reference numerals or symbols denoted in the drawings of the present specification represent members or components that perform substantially the same functions.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Throughout the disclosure, the expression "at least one of a, b or c" indicates only a, only b, only c, both a and b, both a and c, both b and c, all of a, b, and c, or variations thereof.

Hereinafter, embodiments of the disclosure will be described in detail with reference to the accompanying drawings.

Therefore, it is an embodiment of the disclosure to provide an outdoor unit of an air conditioner having an improved structure for cooling a machine room.

It is also an embodiment of the disclosure to provide an outdoor unit of an air conditioner having an improved outer appearance.

Figure 2:
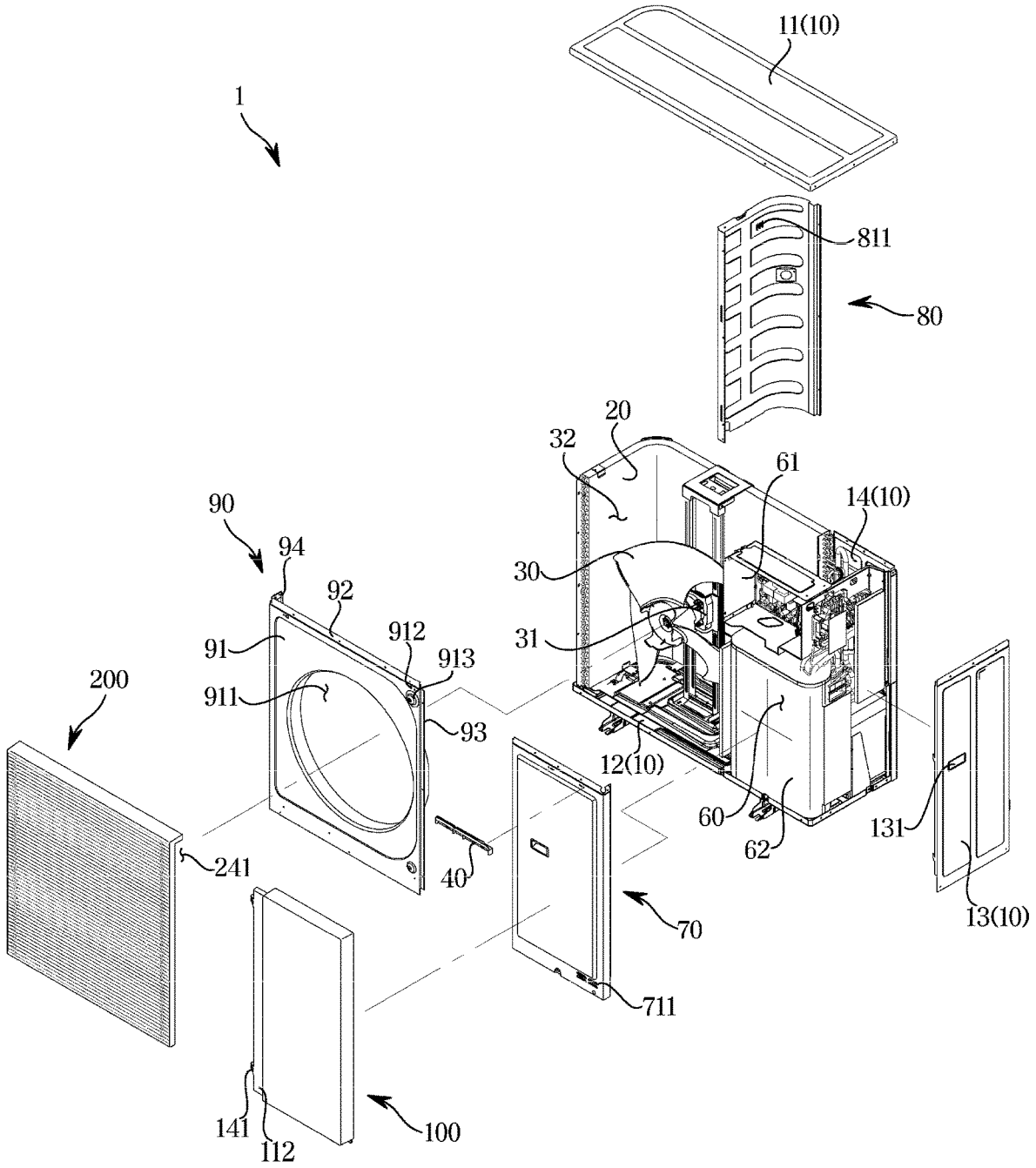
FIG. 2 is an exploded view of the outdoor unit of the air conditioner shown in FIG. 1.

FIG. 1 is a perspective view of an outdoor unit of an air conditioner according to an embodiment of the disclosure, and FIG. 2 is an exploded view of the outdoor unit of the air conditioner shown in FIG. 1.

An air conditioner according to an embodiment of the disclosure may include an indoor unit (not shown) that is placed in an indoor space and an outdoor unit 1 that is placed in an outdoor space. The indoor unit may be connected with the outdoor unit 1 through a refrigerant pipe (not shown) for transferring a refrigerant. Also, the indoor unit may be connected with the outdoor unit 1 through a wire for transferring power and electrical signals.

Also, a single outdoor unit 1 may be connected with a plurality of indoor units (not shown) through refrigerant pipes (not shown).

The indoor unit (not shown) may include an indoor heat exchanger for performing heat exchange with room air, an indoor fan for sucking room air and blowing the room air to cause the room air to pass through the indoor heat exchanger, and an expansion valve unit for decompressing a refrigerant to expand the refrigerant.

The outdoor unit 1 may include, as shown in FIGS. 1 and 2, an outdoor heat exchanger 20 for performing heat exchange with outside air, a fan 30 for sucking outside air and blowing the outside air to cause the outside air to pass through the outdoor heat exchanger 20, a compressor 51 (see FIG. 8) for compressing a refrigerant, and a housing 10 forming an outer appearance of the outdoor unit 1 and accommodating the outdoor heat exchanger 20, the fan 30, and the compressor 51.

Hereinafter, the outdoor unit 1 of the air conditioner according to an embodiment of the disclosure will be described. The outdoor heat exchanger 20 is also referred to as a heat exchanger 20.

Referring to FIGS. 1 and 2, the housing 10 may include a top plate 11, a base plate 12, a side plate 13, and a rear plate 14.

The top plate 11 may form a top of the outdoor unit 1. The base plate 12 may form a bottom of the outdoor unit 1. The heat exchanger 20 and the compressor 51 may be mounted on the base plate 12.

The side plate 13 may be positioned between the top plate 11 and the base plate 12. The side plate 13 may form a side surface of the outdoor unit 1. The side plate 13 may be coupled with the top plate 11 and the base plate 12.

The side plate 13 may partition a machine room 60 which will be described below from outside. The side plate 13 may cover a side of the machine room 60 to prevent outside air from entering the machine room 60.

The side plate 13 may include a side handle 131. The side handle 131 may be coupled with an outer surface of the side plate 13 although a shape of the side handle 131 is not limited thereto. The side handle 131 may be formed by depressing one surface of the side plate 13.

An engineer or a user may access inside of the machine room 60 by gripping the side handle 131 to separate the side plate 13 from the outdoor unit 1.

The rear plate 14 may be positioned between the top plate 11 and the base plate 12. The rear plate 14 may form a portion of a rear surface of the outdoor unit 1. The rear plate 14 may be coupled with the top plate 11 and the base plate 12.

The rear plate 14 may partition the machine room 60 from the outside. The rear plate 14 may cover a rear side of the machine room 60 to prevent outside air from entering the machine room 60. The rear plate 14 may be connected with the side plate 13. The rear plate 14 and the side plate 13 may be integrated into one body.

The outdoor unit 1 may include the heat exchanger 20 and the fan 30. Fan 30 may be a blow fan.

The heat exchanger 20 may be mounted on the base plate 12. The heat exchanger 20 may perform heat exchange with outside air. A refrigerant may flow inside the heat exchanger 20.

The heat exchanger 20 may be accommodated in a fan accommodating room 32 and be influenced by an air current generated by the fan 30.

The fan 30 may be positioned in front of the heat exchanger 20. The fan 30 may be positioned inside the housing 10 to cause air to move. More specifically, the fan 30 may be mounted on the base plate 12.

The fan 30 may generate a flow of air. The fan 30 may form an air current to cause air behind the heat exchanger 20 to move toward the heat exchanger 20. The fan 30 may discharge air passed through the heat exchanger 20, heat-exchanged, and heated to the outside of the outdoor unit 1.

The outdoor unit 1 may include a fan driver 31. The fan driver 31 may be coupled with the fan 30 to drive the fan 30. The fan driver 31 may include a motor for generating power.

Also, the fan 30 may form a circulation flow path C (see FIG. 12) for cooling the machine room 60, which will be described below. Details about this will be described below.

The outdoor unit 1 may include the machine room 60. The machine room 60 may be positioned to one side of the fan 30. The machine room 60 may be formed by partitioning the inside of the outdoor unit 1.

The compressor 51 for compressing a refrigerant may be positioned inside the machine room 60. The control box 52 may be positioned inside the machine room 60. An accommodating frame 62 accommodating the compressor 51 and a control frame 61 accommodating the control box 52 may be positioned inside the machine room 60.

The outdoor unit 1 may include a first partition 70.

The first partition 70 may partition the machine room 60 inside the housing 10. The first partition 70 may be coupled with the base plate 12.

The first partition 70 may include an inlet hole 711 through which air discharged from the fan 30 enters the machine room 60. Details about this will be described below.

The outdoor unit 1 may include a second partition 80.

The second partition 80 may partition the machine room 60 inside the housing 10. The second partition 80 may include an outlet hole 811 through which air cooled in the machine room 60 is sucked into the fan 30.

The second partition 80 may partition an inside space of the housing 10 into a space where the heat exchanger 20 and the fan 30 are installed and a space where the compressor 51 is installed. That is, the machine room 60 may be formed to one side of the second partition 80, and the fan accommodating room 32 may be formed to the other side of the second partition 80.

The second partition 80 may be positioned such that a first end corresponding to a front side of the second partition 80 is connected with the first partition 70 and a second end corresponding to a rear side of the second partition 80 is connected with the heat exchanger 20. Accordingly, the second partition 80 may partition the machine room 60 from the fan accommodating room 32.

The second partition 80 may be in a shape of a curved plate having a substantially curved section, although the shape of the second partition 80 is not limited thereto. The second partition 80 may be in a shape of a rectangle.

The outdoor unit 1 may include a support frame 90.

The support frame 90 may be positioned behind the fan guard 200 to be aligned with the first partition 70 beside the first partition 70, and fix a position of the fan guard 200.

The support frame 90 may include a frame body 91. The frame body 91 may be substantially in a shape of a quadrangular plate. An opening 911 may be formed in the frame body 91.

Air discharged from the fan 30 through the opening 911 may pass through the support frame 90 to be discharged forward from the outdoor unit 1 or enter the machine room 60.

The frame body 91 may include a guard fixing portion 912 and a cover coupling portion 913.

A portion of the fan guard 200 may be inserted in the guard fixing portion 912. The guide fixing portion 912 may temporarily fix a position of the fan guard 200 in a state in which the fan guard 200 is spaced a preset distance from the frame body 91 in a front direction.

More specifically, the guard fixing portion 912 may temporarily fix a position of the fan guard 200 before the fan guard 200 is screw-coupled with the frame body 91. The guard fixing portion 912 may be formed by cutting a portion of the fan guard 200 out.

A front cover 100 may be coupled with the cover coupling portion 913. A portion of the front cover 100 may be inserted in one side of the fan guard 200, and accordingly, the front cover 100 may be aligned with the fan guard 200.

The front cover 100 may be coupled with the frame body 91 through the cover coupling portion 913. Details about an assembly structure of the fan guard 200 and the front cover 100 will be described below.

The support frame 90 may include a plate coupling portion 92 and a partition coupling portion 93.

The support frame 90 may be coupled with the first partition 70 in such a way as to be aligned with the first partition 70 with respect to the front direction. The support frame 90 may be coupled with the first partition 70 through the partition coupling portion 93 extending laterally from the frame body 91. The partition coupling portion 93 may extend from the support frame 90 toward the first partition 70.

The plate coupling portion 92 may extend upward from the frame body 91 of the support frame 90. The support frame 90 may be coupled with the top plate 11 through the plate coupling portion 92.

Also, a lower portion of the frame body 91 of the support frame 90 may be coupled with the base plate 12, although not limited thereto. However, the plate coupling portion 92 may extend downward from the frame body 91 to couple the support frame 90 with the base plate 12.

The support frame 90 may include a heat exchanger coupling portion 94.

The support frame 90 may be coupled with one end of the heat exchanger 20 through the heat exchanger coupling portion 94. The other end of the heat exchanger 20, which is opposite to the one end of the heat exchanger 20, may be coupled with the second partition 80, which will be described below.

Accordingly, the fan accommodating room 32 may be defined by the heat exchanger 20, the support frame 90, and the second partition 80.

The outdoor unit 1 may include the fan guard 200.

The fan guard 200 may be positioned in front of the fan 30. The fan guard 200 may cover a front side of the fan 30 to prevent an external foreign material from entering the inside of the outdoor unit 1. More specifically, the fan guard 200 may cover a front side of the opening 911 of the support frame 90.

The fan guard 200 may discharge air discharged from the fan 30 in the front direction of the outdoor unit 1. More specifically, the fan guard 200 may include a plurality of ribs that are spaced from each other, wherein air is discharged between the plurality of ribs.

The fan guard 200 may include an opening portion 241 at one side toward the first partition 70 such that air discharged from the fan 30 moves toward the machine room 60. Air discharged from the fan 30 may move toward the first partition 70 through the opening portion 241.

More specifically, air passed through the opening portion 241 of the fan guard 200 may move between the front cover 100 and the first partition 70 and enter the machine room 60 through the inlet hole 711 of the first partition 70.

The outdoor unit 1 may include the front cover 100.

The front cover 100 may be aligned with the fan guard 200 beside the fan guard 200, in front of the machine room 60.

The front cover 100 may be positioned in front of the first partition 70 to be aligned with the fan guard 200 beside the fan guard 200. More specifically, the front cover 100 may be positioned in front of the first partition 70 to guide air passed through the opening portion 241 of the fan guard 200 to the inlet hole 711 of the first partition 70.

That is, the front cover 100 may function as a duct forming a flow path through which air discharged from the side of the fan guard 200 enters the machine room 60. The machine room 60 may be cooled by air discharged from the fan 30, and air, which has cooled the machine room 60, is sucked into the fan 30.

The front cover 100 may form a front outer appearance of the outdoor unit 1 together with the fan guard 200.

Hereinafter, detailed structures of individual components of the outdoor unit 1 will be described.

Figure 3:
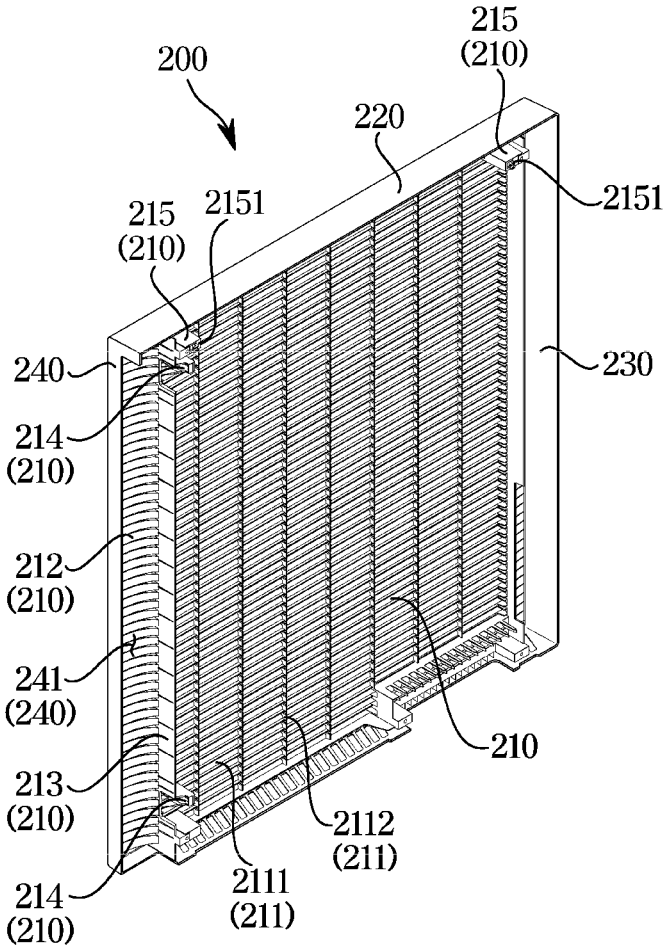
FIG. 3 shows a rear side of a fan guard of the outdoor unit in the air conditioner shown in FIG. 2.
Figure 4:
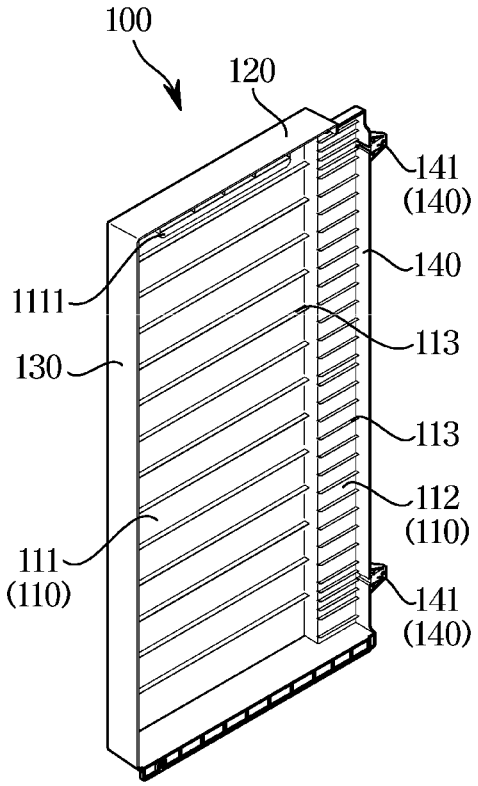
FIG. 4 shows a rear side of a front cover of the outdoor unit in the air conditioner shown in FIG. 2.
Figure 5:
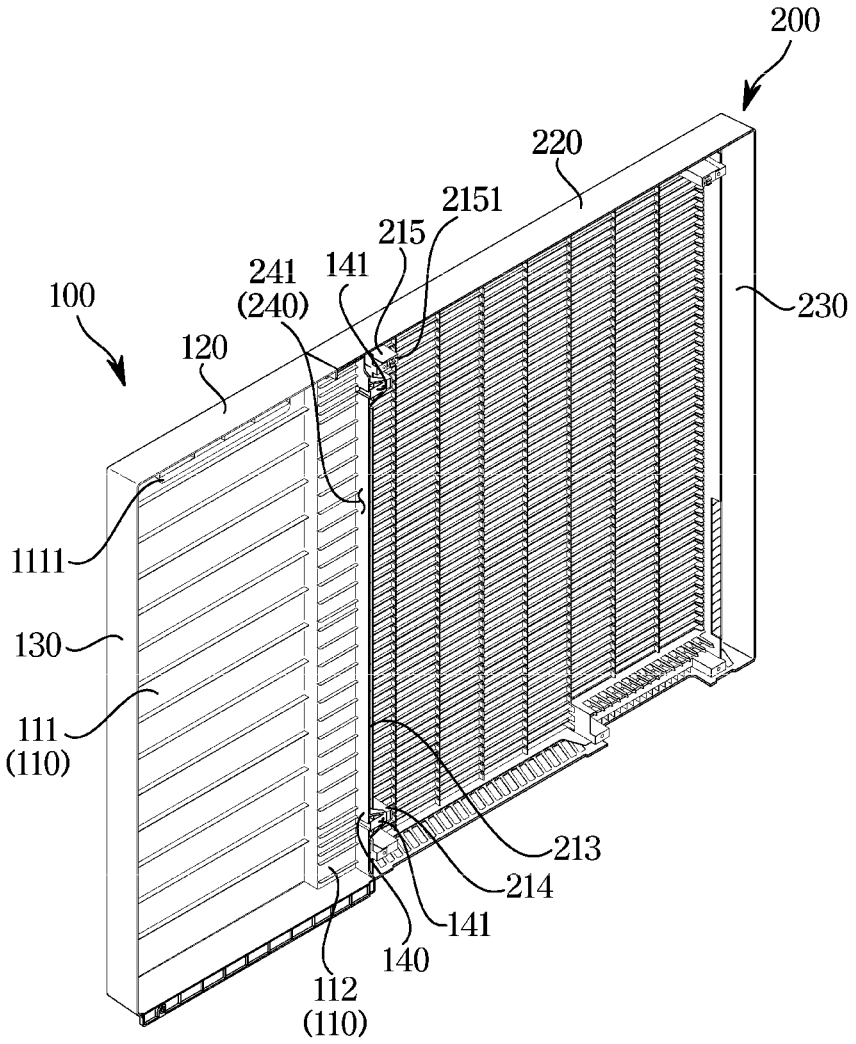
FIG. 5 shows a rear side of a coupled state of the fan guard and the front cover of the outdoor unit in the air conditioner shown in FIG. 2.

FIG. 3 shows a rear side of a fan guard of the outdoor unit in the air conditioner shown in FIG. 2. FIG. 4 shows a rear side of a front cover of the outdoor unit in the air conditioner shown in FIG. 2. FIG. 5 shows a rear side of a coupled state of the fan guard and the front cover of the outdoor unit in the air conditioner shown in FIG. 2.

Referring to FIGS. 2 and 3, the fan guard 200 may include a guard body 210.

The guard body 210 may form a front outer appearance of the fan guard 200. The guard body 210 may include a plurality of ribs.

More specifically, the guard body 210 may include a first rib 2111 and a second rib 2112. The first rib 2111 may be horizontal to a floor. The second rib 2112 may be vertical to the floor.

In other words, the first rib 2111 may extend in a left-right direction of the outdoor unit 1, and the second rib 2112 may extend in an up-down direction of the outdoor unit 12. A plurality of first ribs 2111 and a plurality of second ribs 2112 may be provided.

The plurality of first ribs 2111 and the plurality of second ribs 2112 may be spaced from each other. Air discharged from the fan 30 may move in the front direction from the outdoor unit 1 through gaps between the plurality of ribs formed in the guard body 210.

The first ribs 2111 and the second ribs 2112 may form a main discharge portion 211 of the fan guard 200 together.

The guard body 210 may include a cover accommodating portion 212 formed to one side of the main discharge portion 211.

The cover accommodating portion 212 may accommodate a portion of the front cover 100. The cover accommodating portion 212 may be partitioned from the main discharge portion 211 by a cover supporting portion 213.

The cover supporting portion 213 may support one side of the front cover 100 upon inserting of the front cover 100 into an inner side of the fan guard 200. The cover supporting portion 213 may extend in the rear direction from the fan guard 200. The cover supporting portion 213 may extend along an up-down direction of the fan guard 200.

The guard body 210 may include one or more accommodating ribs 214.

The accommodating rib 214 may protrude in the rear direction from the fan guard 200 to accommodate a frame coupling portion 141 of the front cover 100, which will be described below. The accommodating rib 214 may firmly fix a relative position of the fan guard 200 with respect to the front cover 100.

The guard body 210 may include a frame fixing portion 215 and a plurality of fixing legs 2151.

A plurality of frame fixing portions 215 may be provided on a rear surface of the guard body 210. The frame fixing portion 215 may couple the fan guard 200 with the support frame 90.

The fixing leg 2151 may protrude in the rear direction from the frame fixing portion 215. The fixing leg 2151 may extend in the rear direction from the guard body 210 to be inserted in the support frame 90. The fixing leg 2151 may be inserted in the guard fixing portion 912 (see FIG. 2) of the support frame 90.

Accordingly, because the fixing leg 2151 is inserted in the guard fixing portion 912 of the support frame 90 even in a state in which the fan guard 200 is not completely coupled with the support frame 90 by a separate coupling member, the fan guard 200 may be temporarily fixed with respect to the support frame 90.

The fan guard 200 may include a first upper flange 220 extending in the rear direction from an upper portion of the guard body 210. The first upper flange 220 may form a top surface of the fan guard 200.

The fan guard 200 may include a first outer side flange 230 extending from one side of the guard body 210 in the rear direction.

The first outer side flange 230 may form one side surface of the fan guard 200. The first outer side flange 230 may be exposed to the outside of the outdoor unit 1. The first outer side flange 230 may be connected with the first upper flange 220.

The fan guard 200 may include a first inner side flange 240 extending from the other side of the guard body 210 in the rear direction, the first inner side flange 240 being opposite to the one side of the guard body 210.

The first inner side flange 240 may form the other side surface of the fan guard 200, which is opposite to the one side surface of the fan guard 200. The first inner side flange 240 may be in contact with the front cover 100. The first inner side flange 240 may be connected with the first upper flange 220. The first inner side flange 240 may be connected with the cover accommodating portion 212 of the guard body 210.

The first inner side flange 240 may include the opening portion 241.

The opening portion 241 may be formed by cutting a portion of the first inner side flange 240 out. The opening portion 241 may be formed by cutting a main portion of the first inner side flange 240 out except for an upper portion of the first inner side flange 240.

Referring to FIGS. 2 and 4, the front cover 100 may include a cover body 110.

The cover body 110 may form a front outer appearance of the front cover 100. The cover body 110 may include a body portion 111 and a guard accommodating portion 112.

The guard accommodating portion 112 may extend from the body portion 111 toward the fan guard 200. The guard accommodating portion 112 may form a step with the body portion 111. More specifically, the guard accommodating portion 112 may form a step with the body portion 111 in such a way as to be depressed from the body portion 111 in the rear direction.

The guard accommodating portion 112 may extend toward the fan guard 200 to be slidingly inserted into the inner side of the fan guard 200 through the opening portion 241.

The front cover 100 may include the frame coupling portion 141.

The frame coupling portion 141 may extend outward from the guard accommodating portion 112 and be coupled with the support frame 90. The frame coupling portion 141 may protrude from the guard accommodating portion 112 toward the fan guard 200.

More specifically, the frame coupling portion 141 may be coupled with the cover coupling portion 813 of the support frame 90 by a separate coupling member.

The front cover 100 may include a plurality of reinforced ribs 113. The reinforced rib 113 may protrude from a rear surface of the cover body 110 in the rear direction. The reinforced rib 113 may extend in a horizontal direction. The reinforced rib 113 may reinforce strength of the front cover 100.

A guide accommodating portion 1111 may be formed in an upper portion of the cover body 110. The guide accommodating portion 1111 may accommodate a guide member, also referred to as a guide rack, 40, that is coupled with the first partition 70. Details about this will be described below.

The front cover 100 may include a second upper flange 120 extending from the upper portion of the cover body 110 in the rear direction.

The second upper flange 120 may form a top surface of the front cover 100. The second upper flange 120 may be positioned at the same height as the first upper flange 220 of the fan guard 200. The second upper flange 120 may be aligned with the first upper flange 220 of the fan guard 200 beside the first upper flange 220.

The front cover 100 may include a second outer side flange 130 extending from one side of the cover body 110 in the rear direction.

The second outer side flange 130 may form one side surface of the cover body 110. The second outer side flange 130 may be exposed to the outside of the outdoor unit 1. The second outer side flange 130 may be connected with the second upper flange 120.

The front cover 100 may include a second inner side flange 140 extending from the other side of the cover body 110 in the rear direction, the second inner side flange 140 being opposite to the one side of the cover body 110.

The second inner side flange 140 may form the other side surface of the cover body 110, which is opposite to the one side surface of the cover body 110. The second inner side flange 140 may be in contact with the cover supporting portion 213 of the fan guard 200. The second inner side flange 140 may be connected with the second upper flange 120. The second inner side flange 140 may be connected with the guard accommodating portion 112 of the cover body 110.

The frame coupling portion 141 may extend outward from the second inner side flange 140.

A state in which the front cover 100 is inserted in the fan guard 200 will be described with reference to FIGS. 3 to 5, below.

The guard accommodating portion 112 of the front cover 100 may be accommodated in the cover accommodating portion 212 of the fan guard 200. The second inner side flange 140 of the front cover 100 may face the cover supporting portion 213 of the fan guard 200 such that the second inner side flange 140 is in contact with the cover supporting portion 213.

The frame coupling portion 141 of the front cover 100 may be accommodated in the accommodating rib 214 of the fan guard 200.

The second upper flange 120 of the front cover 100 may be aligned with the first upper flange 220 of the fan guard 200 beside the first upper flange 220 to be positioned at the same height as the first upper flange 220. Also, as shown in FIG. 1, a front surface of the cover body 110 of the front cover 100 may be aligned with a front surface of the guard body 210 of the fan guard 200 beside the front surface of the guard body 210 with respect to the front direction.

Accordingly, the fan guard 200 and the front cover 100 may give a sense of unity although fan guard 200 and the front cover 100 are provided as separate components.

However, the fan guard 200 and the front cover 100 may be integrated into one body.

Figure 6:
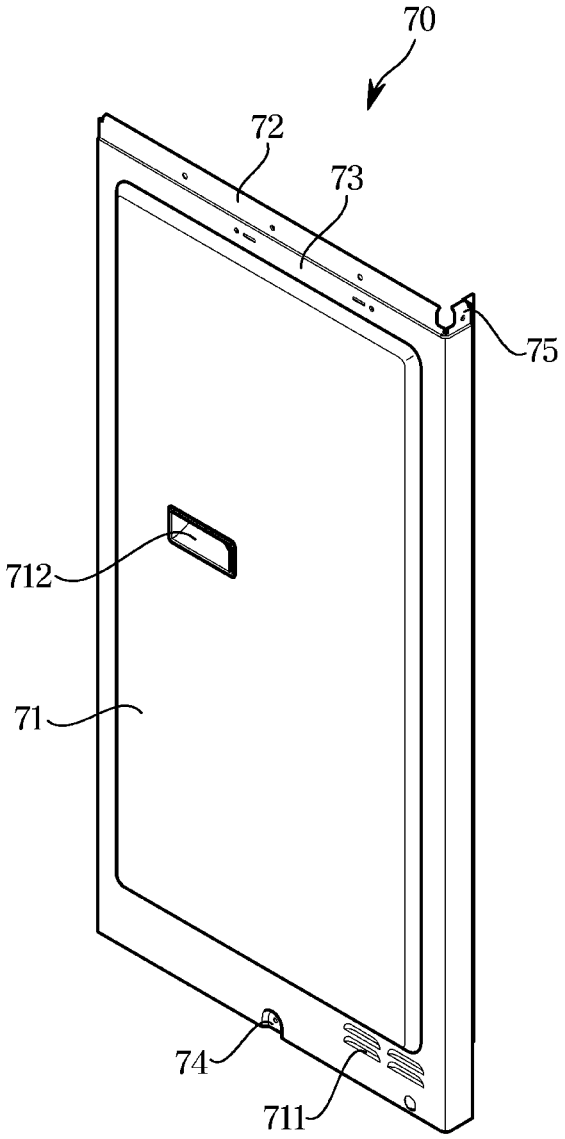
FIG. 6 shows a first partition of the outdoor unit of the air conditioner shown in FIG. 2.

FIG. 6 shows a first partition of the outdoor unit of the air conditioner shown in FIG. 2.

Referring to FIG. 6, the first partition 70 may include a first body 71.

The first body 71 may form a front outer appearance of the first partition 70. In the first body 71 of the first partition 70, the inlet hole 711 communicating with the machine room 60 may be formed. The inlet hole 711 may be formed as a lancing hole through a lancing process.

In the first body 71, a handle 712 may be formed. An engineer or a user may access the inside of the machine room 60 as necessary by gripping the handle 712 of the first body 71 to separate the first partition 70 from the outdoor unit 1.

A guide coupling portion 73 may be formed in an upper portion of the first body 71.

The guide rack 40 may be coupled with the guide coupling portion 73. The guide rack 40 may be a component for temporarily fixing the front cover 100 that is inserted into the fan guard 200 in front of the first partition 70.

The first partition 70 may include a top coupling portion 72 extending upward from the first body 71. The top coupling portion 72 may be coupled with the top plate 11. Accordingly, the first partition 70 may be coupled with the top plate 11.

The first partition 70 may include a side coupling portion 75 extending from the first body 71 in the rear direction. The side coupling portion 75 may be coupled with the side plate 13. Accordingly, the first partition 70 may be coupled with the side plate 13.

A base coupling portion 74 may be provided in a lower front portion of the first body 71 of the first partition 70 to couple the first partition 70 with the base plate 12.

Also, a coupling portion extending from the first body 71 in the rear direction may also be formed in one side of the first partition 70, which is opposite to the side coupling portion 75 of the first partition 70, which is not shown.

Therefore, an outer end of the first partition 70 may be coupled with the side plate 13, and an inner end of the first partition 70 may be coupled with the second partition 80.

Figure 7:
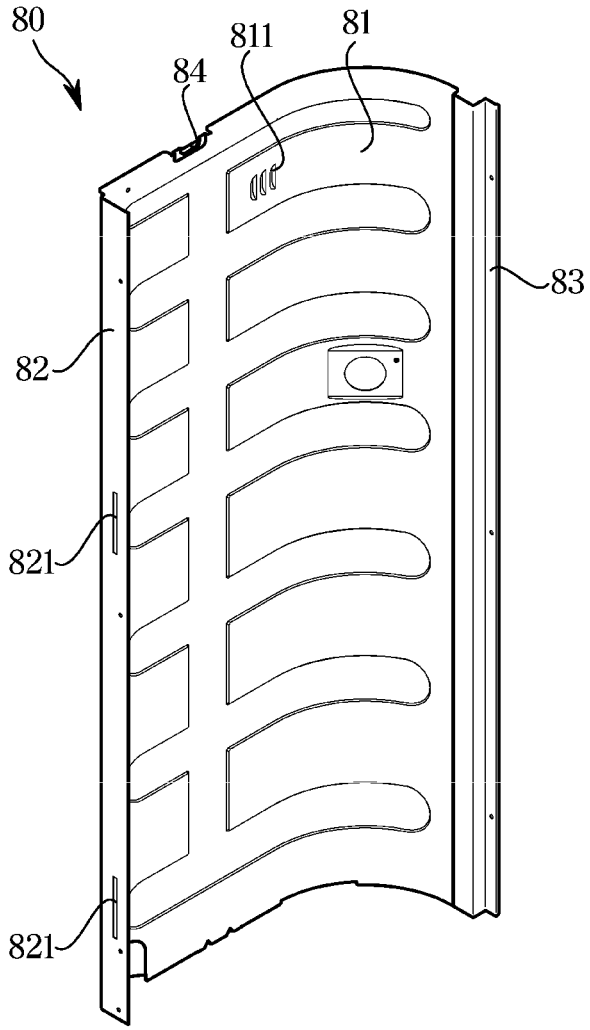
FIG. 7 shows a second partition of the outdoor unit of the air conditioner shown in FIG. 2.

FIG. 7 shows a second partition of the outdoor unit of the air conditioner shown in FIG. 2.

Referring to FIG. 7, the second partition 80 may include a second body 81.

The second body 81 may be provided in a shape of a wide plate to partition the machine room 60 from the fan accommodating room 32. In the second body 81 of the second partition 80, an outlet hole 811 communicating with the machine room 60 and the fan accommodating room 32 may be formed. The outlet hole 811 may be formed as a lancing hole through a lancing process.

The second partition 80 may include a partition coupling portion 82 formed in a front end of the second body 81 and a heat exchanger coupling portion 83 formed in a rear end of the second body 81.

The partition coupling portion 82 may be formed by being bent from the front end of the second body 81. The partition coupling portion 82 may be coupled with the first partition 70.

In the partition coupling portion 82, a coupling slit 821 in which a fixing protrusion (not shown) of the first partition 70 is inserted may be formed. Accordingly, relative positions of the first partition 70 and the second partition 80 may be fixed even in a state in which the second partition 80 is not coupled with the first partition 70 by a separate coupling member.

The heat exchanger coupling portion 83 may be formed by being bent from the rear end of the second body 81 to be coupled with the heat exchanger 20. As described above, one side end of the heat exchanger 20 may be coupled with the support frame 90, and the other side end of the heat exchanger 20 may be coupled with the second partition 80.

In an upper portion of the second body 81 of the second partition 80, a frame supporting portion 84 may be formed. The control frame 61 positioned in an upper area of the machine room 60 may be inserted in the frame supporting portion 84. Accordingly, a position of the control frame 61 may be fixed inside the machine room 60.

Figure 8:
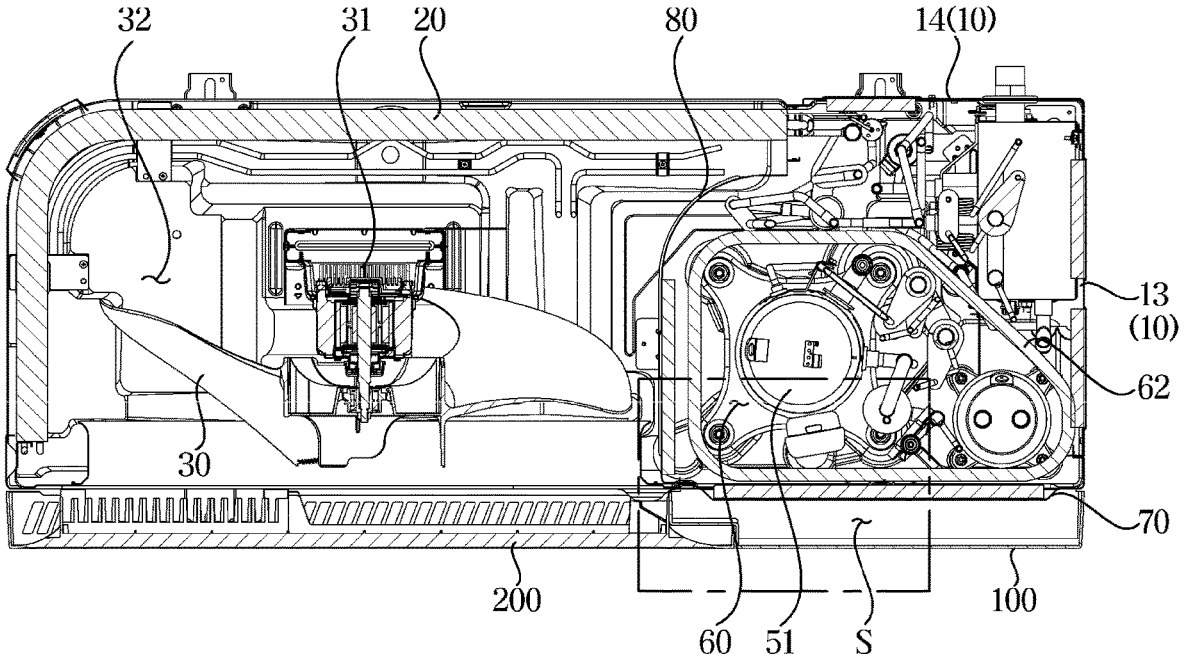
FIG. 8 is a cross-sectional view of the outdoor unit of the air conditioner, taken along line A-A' of FIG. 1.

FIG. 8 is a cross-sectional view of the outdoor unit of the air conditioner, taken along line A-A' of FIG. 1.

Referring to FIG. 8, the outdoor unit 1 may be partitioned into the fan accommodating room 32 and the machine room 60.

The machine room 60 may be defined by the side plate 13, the rear plate 14, the first partition 70, and the second partition 80. More specifically, the other side end of the heat exchanger 20 may be positioned between the rear plate 14 and the second partition 80 to form a closed space defining the machine room 60.

The fan accommodating room 32 may be defined by the heat exchanger 20, the support frame 90, and the second partition 80. In the fan accommodating room 32, the fan 30 and the fan driver 31 may be positioned.

The compressor 51 may be accommodated in the accommodating frame 62 of the machine room 60.

The front cover 100 may be spaced from a front surface of the first partition 70 such that a flow space S is formed between the front cover 100 and the first partition 70. The front cover 100 may form a circulation flow path C which will be described below.

Figure 9:
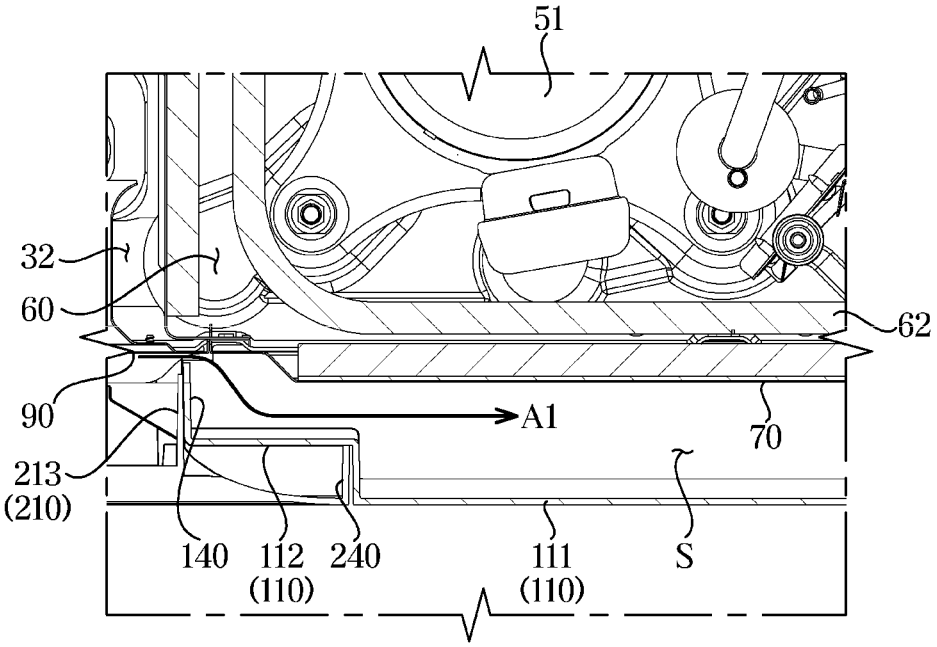
FIG. 9 sequentially shows flows of air of a circulation flow path in an outdoor unit of an air conditioner according to an embodiment of the disclosure.
Figure 10:
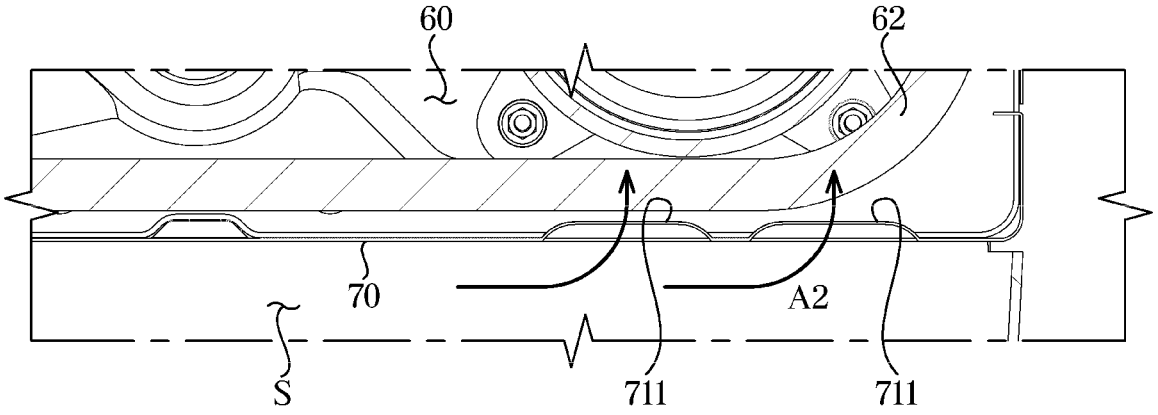
FIG. 10 sequentially shows flows of air of a circulation flow path in an outdoor unit of an air conditioner according to an embodiment of the disclosure.
Figure 11:
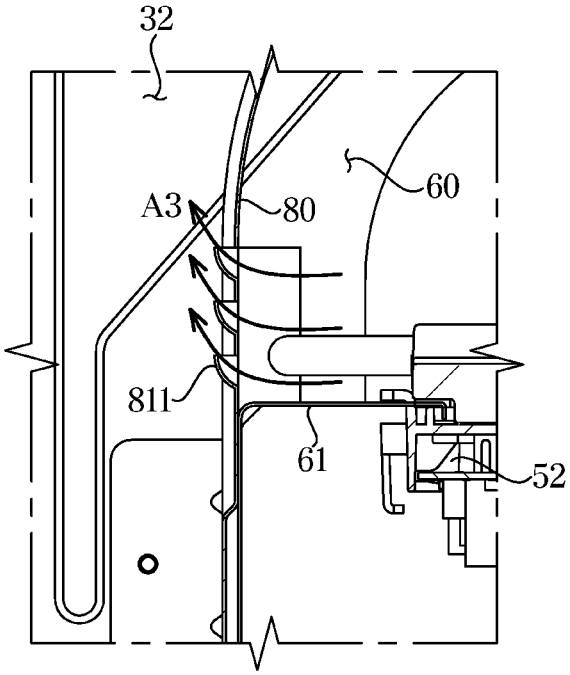
FIG. 11 sequentially shows flows of air of a circulation flow path in an outdoor unit of an air conditioner according to an embodiment of the disclosure.

FIGS. 9 to 11 sequentially show flows of air of a circulation flow path in an outdoor unit of an air conditioner according to an embodiment of the disclosure.

FIG. 9 is an enlarged view of a denoted area in FIG. 8, and referring to FIG. 9, a part of air discharged from the fan 30 may flow toward the front cover 100 through the opening portion 241 of the fan guard 200.

More specifically, the outdoor unit 1 according to an embodiment of the disclosure may include a first flow path A1 along which air discharged from the fan 30 flows between the cover supporting portion 213 of the fan guard 200, the second inner side flange 140 of the front cover 100, and the support frame 90 toward the flow space S formed between the front cover 100 and the first partition 70.

In other words, the first flow path A1 may be a flow path along which air discharged from the fan 30 flows toward the lateral direction through the opening portion 241 of the fan guard 200.

FIG. 10 is a cross-sectional view of the outdoor unit 1 according to an embodiment of the disclosure, showing the inlet hole 711 of the first partition 70.

Referring to FIG. 10, the outdoor unit 1 may include a second flow path A2 along which air moved to the flow space S along the first flow path A1 enters the machine room 60 through the inlet hole 711 of the first partition 70.

Because the front cover 100 forms the flow space S between the fan guard 200 and the first partition 70, air discharged toward the lateral direction of the fan guard 200 may move toward the inlet hole 711 of the first partition 70 by flow pressure of the fan 30. That is, positive pressure may be formed in the flow space S.

FIG. 11 is a cross-sectional view of the outdoor unit 1 according to an embodiment of the disclosure, showing the outlet hole 811 of the second partition 80.

Referring to FIG. 11, the outdoor unit 1 may include a third flow path A3 along which air entered the machine room 60 along the second flow path A2 cools various components, such as the compressor 51 and the control box 52, of the machine room 60 and is discharged to the fan accommodating room 32 through the outlet hole 811 of the second partition 80.

Air may return to the fan 30 by flow pressure of the fan 30. That is, the third flow path A3 may cause air to move from the machine room 60 to the fan accommodating room 32 by negative pressure.

Figure 12:
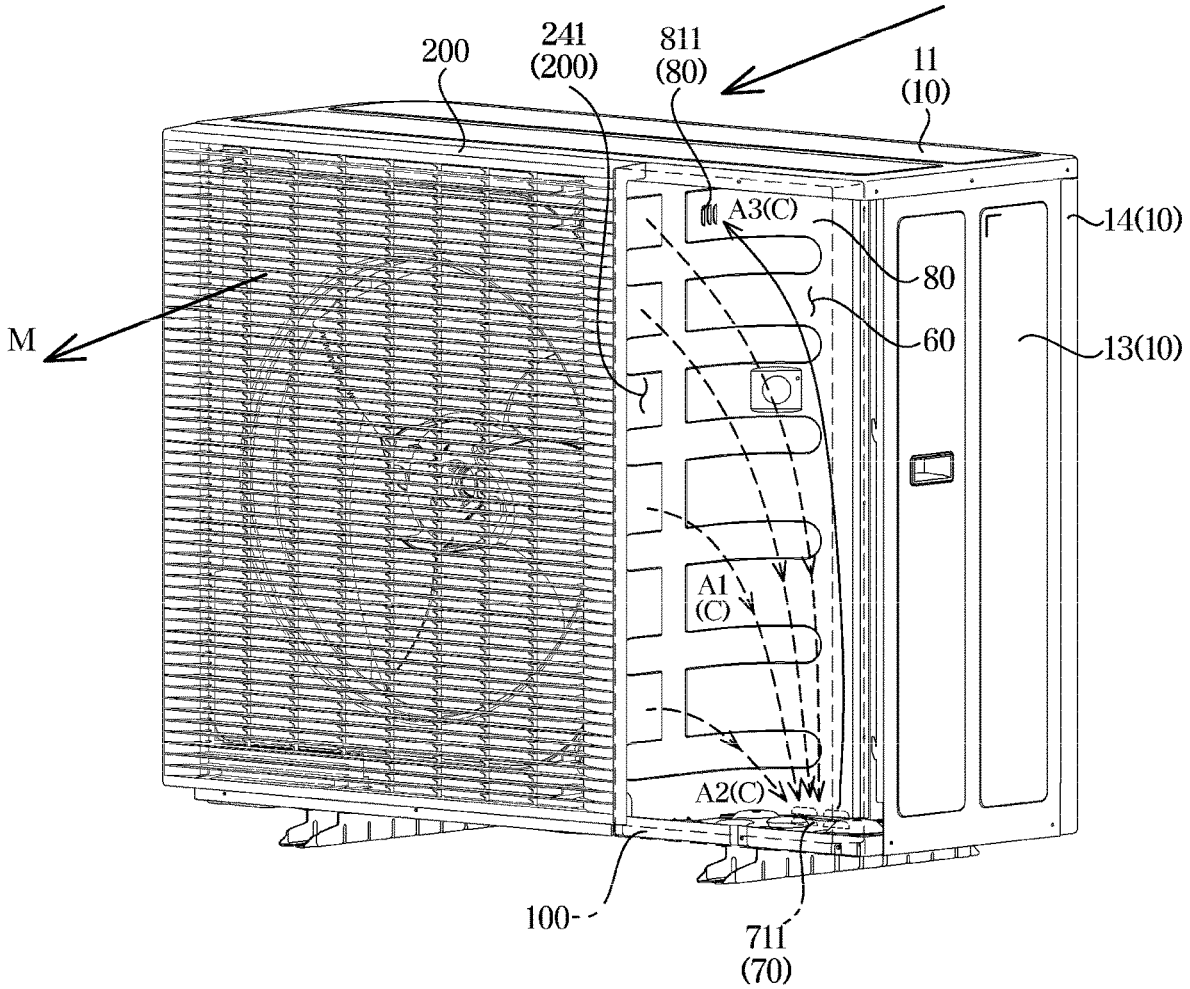
FIG. 12 shows flows of air of a main flow path and a circulation flow path in an outdoor unit of an air conditioner according to an embodiment of the disclosure.

FIG. 12 shows flows of air of a main flow path and a circulation flow path in an outdoor unit of an air conditioner according to an embodiment of the disclosure.

Referring to FIGS. 9 to 12, the outdoor unit 1 may include a main flow path M and a circulation flow path C.

The circulation flow path C may include the first flow path A1, the second flow path A2, and the third flow path A3.

The main flow path M may be a path along which air sucked into the fan 30 passes through the heat exchanger 20 and then is discharged in the front direction of the fan guard 200. Air flowing along the main flow path M may perform heat exchange with the heat exchanger 20 and cool a refrigerant.

The circulation flow path C may be a path along which air discharged in the front direction of the fan 30 flows in the lateral direction through the opening portion 241 of the fan guard 200 to cool the machine room 60 and then returns to the fan 30.

Accordingly, a part of air discharged from the fan 30 may flow in the front direction of the fan 30 and be discharged in the front direction of the fan guard 200, and the remaining part of the air discharged from the fan 30 may flow in the front direction of the fan 30 and be discharged in the lateral direction of the fan guard 200.

More specifically, the circulation flow path C may be a path along which a part of air discharged in the front direction of the fan 30 flows between the first partition 70 and the front cover 100 through the side of the fan guard 200, enters the machine room 60 through the inlet hole 711 of the first partition 70 to cool the machine room 60, and returns to the fan 30 through the outlet hole 811 of the second partition 80.

In other words, the circulation flow path C may be a path along which air discharged from the fan 30 flows in the lateral direction of the fan guard 200, enters the machine room 60 from the space S formed between the front cover 100 and the first partition 70 to cool the machine room 60, and then sucks into the fan 30 in front of the heat exchanger 20.

Accordingly, to cause air to smoothly flow along the circulation flow path C, the rear plate 14, the side plate 13, and the top plate 11 forming three sides of the machine room 60 may block the machine room 60 from the outside.

As shown in FIG. 12, the inlet hole 711 of the first partition 70 may be formed at a lower height than the outlet hole 811 of the second partition 80. Accordingly, air entered the machine room 60 through the inlet hole 711 may flow from a lower area of the machine room 60 to an upper area of the machine room 60 to efficiently cool the entire of the machine room 60.

Also, the inlet hole 711 of the first partition 70 may be positioned ahead of the fan 30, and the outlet hole 811 of the second partition 80 may be positioned behind the fan 30. Accordingly, positive pressure at which air is discharged from the fan 30 may be formed around the inlet hole 711, and negative pressure at which air is sucked into the fan 30 may be formed around the outlet hole 811.

However, the positions of the inlet hole 711 of the first partition 70 and the outlet hole 811 of the second partition 80 are not limited. The inlet hole 711 may be formed upstream of an air current formed by the fan 30, and the outlet hole 811 may be formed downstream of the air current as long as air flows from the inlet hole 711 to the outlet hole 811.

That is, the outdoor unit 1 of the air conditioner according to a concept of the disclosure may have any structure in which the machine room 60 is cooled by air discharged from the fan 30 and the air that cooled the machine room 60 is sucked into the fan 30.

Also, the inlet hole 711 of the first partition 70 may be provided as a lancing hole of which a lower portion opens. Accordingly, a refrigerant leaking to the inside of the machine room 60 may be easily discharged to the outside of the machine room 60 through the inlet hole 711 of the first partition 70. Thereby, accidents that may occur inside the machine room 60 may be prevented in advance.

An existing air conditioner has cooled a machine room by forming an inlet in a side plate to cause outside air to directly enter the machine room.

In the outdoor unit 1 of the air conditioner according to an embodiment of the disclosure, because a flow path for cooling the machine room 60 circulates inside the outdoor unit 1, the machine room 60 may be cooled with the same performance regardless of an installation location of the outdoor unit 1. In other words, even in a case in which one side of the outdoor unit 1 is installed on a wall in such a way as to be in close contact with the wall, the same degree of cooling performance for the machine room 60 may be secured.

Also, because a flow of air flowing along the circulation flow path C for cooling the machine room 60 is formed relatively more rapidly than in the case of causing outside air to enter the machine room 60 and cool the machine room 60, cooling efficiency per hour may increase.

The above-described front cover 100 of the outdoor unit 1 according to an embodiment of the disclosure is shown to itself be provided as a duct forming a flow path between the fan guard 200 and the first partition 70 and described. However, the front cover 100 is not limited to such a duct, and a separate duct protruding from the rear surface of the front cover 100 in the rear direction may be formed.

Also, the above-described fan guard 200 of the outdoor unit 1 according to an embodiment of the disclosure is shown to include the opening portion 241 having a long length in the up-down direction, cut out from the first inner side flange 240, and described.

However, the opening portion 241 of the fan guard 200 is not limited to such a shape, and the opening portion 241 may be provided with a small length by cutting out a portion of the first inner side flange 240 by a short range.

In this case, the duct of the front cover 100 may extend from the rear surface of the front cover 100 in the rear direction to connect the opening portion 241 of the fan guard 200 with the inlet hole 711 of the first partition 70.

Figure 13:
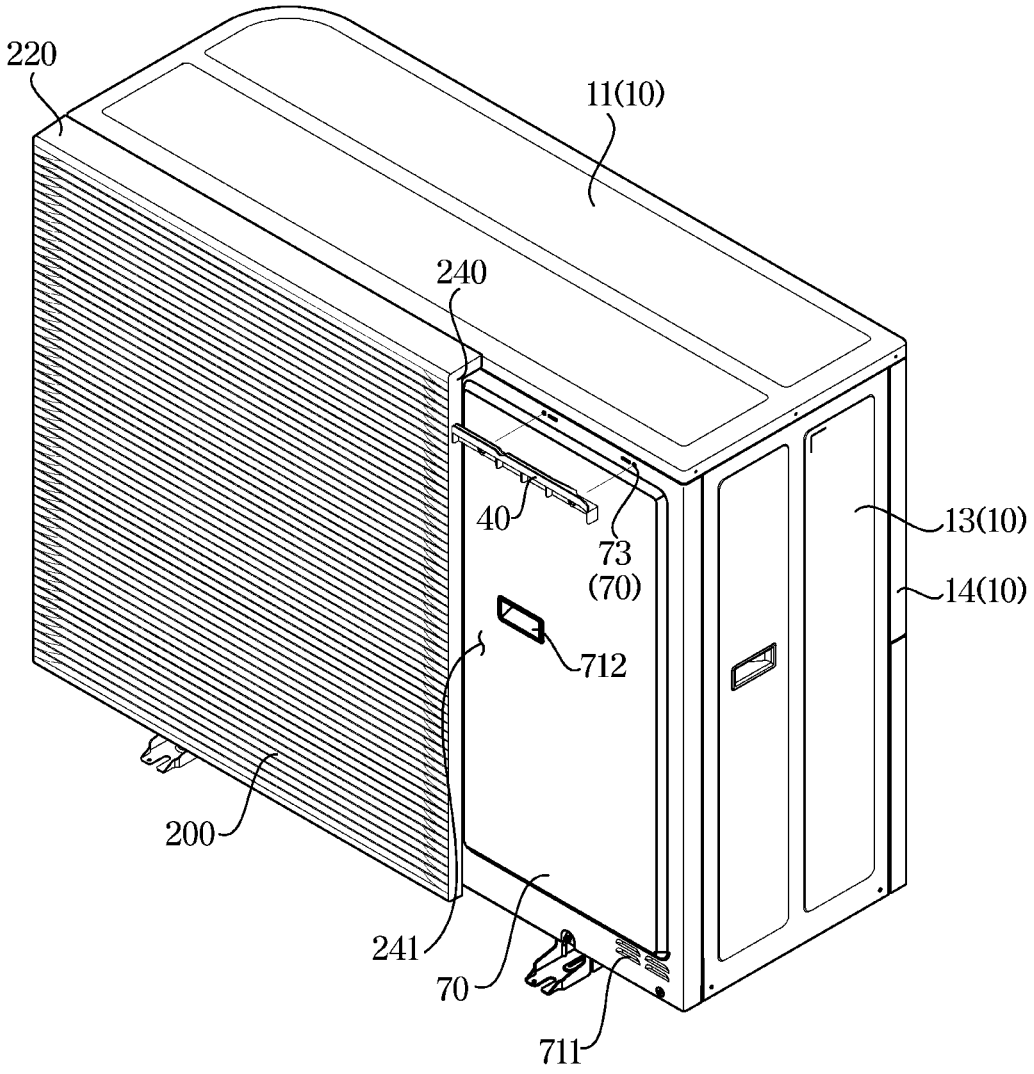
FIG. 13 shows a process of coupling a front cover with a fan guard in an outdoor unit of an air conditioner according to an embodiment of the disclosure.
Figure 14:
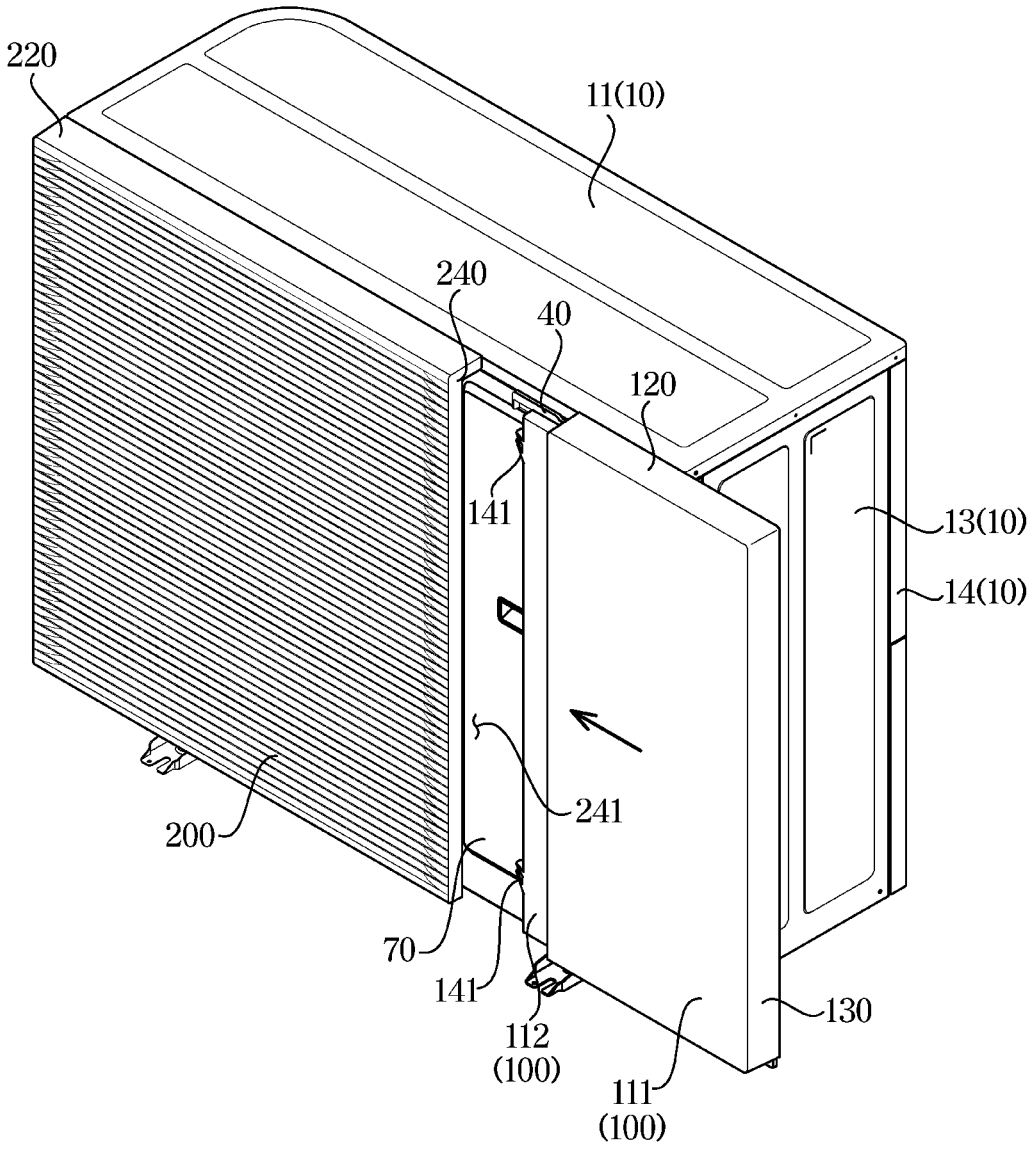
FIG. 14 shows a process of coupling a front cover with a fan guard in an outdoor unit of an air conditioner according to an embodiment of the disclosure.

FIG. 13 shows a process of coupling a front cover with a fan guard in an outdoor unit of an air conditioner according to an embodiment of the disclosure. FIG. 14 shows a process of coupling a front cover with a fan guard in an outdoor unit of an air conditioner according to an embodiment of the disclosure.

Referring to FIGS. 13 and 14, the guide member 40 may be coupled with the guide coupling portion 73 of the first partition 70.

The guide member 40 may be coupled with the first partition 70 to maintain a position of the front cover 100 upon sliding of the front cover 100 from the side of the fan guard 200 to be inserted into the inner side of the fan guard 200.

The guide member 40 may be coupled with an upper front portion of the first partition 70.

After the guide member 40 is coupled with the guide coupling portion 73 of the first partition 70, the front cover 100 may slide toward the fan guard 200 and be inserted into the opening portion 241 of the fan guard 200.

More specifically, the frame coupling portion 141 extending from the second inner side flange 140 of the front cover 100 may be inserted in the inner side of the fan guard 200 through the opening portion 241 of the fan guard 200.

Accordingly, the front cover 100 may be coupled in a last operation of a process of manufacturing the outdoor unit 1.

As shown in FIG. 5, after the front cover 100 slides and thus the guard accommodating portion 112 is rested on the cover accommodating portion 212 of the fan guard 200, the guide member 40 may be inserted into the guide accommodating portion 1111 (see FIG. 4) of the front cover 100.

Accordingly, a movement in left-right direction of the front cover 100 may be prevented. That is, by inserting the front cover 100 into the opening portion 241 of the fan guard 200 in the lateral direction and inserting the guide member 40 into the guide accommodating portion 1111 of the front cover 100, a position of the front cover 100 may be temporarily fixed. According to an operation of the outdoor unit 1 of the air conditioner, vibrations may be generated. Accordingly, in the outdoor unit 1 of the air conditioner according to an embodiment of the disclosure, the front cover 100 may be coupled with the fan guard 200 in a state of being in close contact with the fan guard 200. Also, by fixing the front cover 100 and the fan guard 200 together to the support frame 90, noise that is generated by assembly tolerance may be reduced. Accordingly, the guide member 40 may temporarily fix a position of the front cover 100 before the front cover 100 is completely coupled with the fan guard 200.

In this case, the frame coupling portion 141 of the front cover 100 may be accommodated in the accommodating rib 214 of the fan guard 200. Also, the frame coupling portion 141 of the front cover 100 may be positioned to correspond to the cover coupling portion 913 of the support frame 90. That is, the front cover 100 may be positioned with respect to the fan guard 200 in the same state as shown in FIG. 5.

Thereafter, an engineer may insert a tool between the plurality of ribs of the fan guard 200 to couple the frame coupling portion 141 of the front cover 100 with the cover coupling portion 913 of the support frame 90 through a coupling member.

The outdoor unit 1 of the air conditioner according to an embodiment of the disclosure may reduce assembly tolerance between the fan guard 200 and the front cover 100 provided as a separate component. Also, the engineer may assembly the front cover 100 with the fan guard 200 by a more simplified method.

The front cover 100 may include a polypropylene (PP) material.

The front cover 100 may form a front outer appearance of the outdoor unit 1 together with the fan guard 200 beside the fan guard 200. Accordingly, the front cover 100 may be customized in color according to a user's needs due to material characteristics. Thereby, the outdoor unit 1 of the air conditioner may give an improved aesthetic sense.

According to the disclosure, by forming the circulation flow path such that air circulates inside the outdoor unit, the machine room may be cooled without being influenced by an installation location of the outdoor unit.

Also, because a leaking refrigerant is discharged quickly to the outside through the inlet hole of the first partition, an occurrence risk of accidents may be reduced.

Also, by assembling the front cover capable of being customized in color, an aesthetic sense of the outdoor unit may increase.

So far, specific embodiments have been shown and described. However, the disclosure is not limited to the above-described embodiments, and various modifications can be made by those skilled in the art without departing from the gist of the technical idea of the disclosure defined by the claims below.

What is claimed is:

1. An outdoor unit of an air conditioner, the outdoor unit comprising:

a housing;

a fan inside the housing and configured to cause air flow;

a machine room inside the housing at—one side of the fan;

a first partition inside the housing and defining a front of the machine room—, the first partition including an inlet hole through which a portion of the air flow from the—fan enters the machine room;

a second partition inside the housing between the fan and the machine room— and defining a side of the machine room, the second partition including an outlet hole through which air in the machine room is sucked toward the fan;

a fan guard in front of the fan, the fan guard including an opening portion on one side of the fan guard that is positioned toward the first partition such that the portion of the air flow—from the fan passes through the opening portion and moves toward the first partition; and a front cover in front of the first partition and configured to guide the portion of the air flow having passed through the opening portion of the fan guard to the inlet hole of the first partition.

2. The outdoor unit of claim 1, wherein the front cover is aligned with the fan guard beside the fan guard, in front of the machine room.

3. The outdoor unit of claim 1, wherein the housing comprises:

a side plate configured to cover a lateral side of the machine room and prevent outside air from entering the machine room; and a rear plate configured to cover a rear side of the machine room and prevent outside air from entering the machine room, the rear plate connected with the side plate.

4. The outdoor unit of claim 1, further comprising a guide rack coupleable with the first partition and configured to maintain the front cover inserted in an inner side of the fan guard by sliding from a side of the fan guard.

5. The outdoor unit of claim 1, wherein the inlet hole is formed at a lower height than the outlet hole.

6. The outdoor unit of claim 1, wherein the inlet hole is positioned to a side of a center of the fan, and the outlet hole is positioned behind the center of the fan.

7. The outdoor unit of claim 1, wherein the machine room is cooled by the portion of the air flow from the fan that enters the machine room and, which is then sucked through the outlet hole of the second partition by the fan.

8. The outdoor unit of claim 1, wherein the front cover includes a polypropylene material.

9. The outdoor unit of claim 1, further comprising:

a heat exchanger inside the housing and configured to perform heat exchange with outside air so that:

air sucked into the fan passes through the heat exchanger and heat exchanged air is discharged along a front direction of the fan guard, via a main flow path; and the portion of the air flow from the fan flows in a lateral direction through the opening portion of the fan guard to cool the machine room and return to the fan via a circulation flow path.

10. The outdoor unit of claim 9, wherein the front cover is spaced from a front surface of the first partition to provide a flow space between the front cover and the first partition, thereby forming a portion of the circulation flow path.

11. The outdoor unit of claim 9, wherein a first end corresponding to a front side of the second partition is connected with the first partition and a second end corresponding to a rear side of the second partition is connected with the heat exchanger to separate the machine room from a fan room in which the fan is accommodated.

12. The outdoor unit of claim 1, further comprising a support frame aligned with the first partition beside the first partition, behind the fan guard, and configured to maintain a position of the fan guard.

13. The outdoor unit of claim 12, wherein the front cover comprises a guard accommodating portion extending toward the fan guard and configured to be slidable and insertable into an inner side of the fan guard through the opening portion.

14. The outdoor unit of claim 13, wherein the front cover further comprises a frame coupling portion extending outward from the guard accommodating portion and coupleable with the support frame.

15. The outdoor unit of claim 12, wherein the fan guard comprises a fixing leg protruding from a rear surface of the fan guard in a rear direction and configured to be insertable in the support frame.

16. An outdoor unit of an air conditioner, the outdoor unit comprising:

a housing;

a fan inside the housing and configured to cause air to flow;

a machine room inside the housing at one side of the fan;

a first partition inside the housing in front of the machine room, the first partition including an inlet hole through which air flow from the fan enters the machine room;

a second partition inside the housing between the fan and the machine room, the second partition including an outlet hole through which air in the machine room is sucked toward the fan;

a fan guard in front of the fan, the fan guard including an opening portion on one side of the fan guard that is positioned toward the first partition such that the air flow from the fan moves toward the machine room;

a front cover in front of the first partition and configured to guide air having passed through the opening portion of the fan guard to the inlet hole of the first partition; and a support frame aligned with the first partition beside the first partition, behind the fan guard, and configured to maintain a position of the fan guard.

17. The outdoor unit of claim 16, wherein the fan guard comprises a fixing leg protruding from a rear surface of the fan guard in a rear direction and configured to be insertable in the support frame.

18. The outdoor unit of claim 16, wherein the front cover comprises a guard accommodating portion extending toward the fan guard and configured to be slidable and insertable into an inner side of the fan guard through the opening portion.

19. The outdoor unit of claim 18, wherein the front cover further comprises a frame coupling portion extending outward from the guard accommodating portion and coupleable—with the support frame.

20. An outdoor unit of an air conditioner, the outdoor unit comprising:

a housing;

a fan inside the housing and configured to cause air to flow;

a machine room inside the housing at one side of the fan;

a first partition inside the housing in front of the machine room, the first partition including an inlet hole through which air flow from the fan enters the machine room;

a second partition inside the housing between the fan and the machine room, the second partition including an outlet hole through which air in the machine room is sucked toward the fan;

a fan guard in front of the fan, the fan guard including an opening portion on one side of the fan guard that is positioned toward the first partition such that the air flow from the fan moves toward the machine room;

a front cover in front of the first partition and configured to guide air having passed through the opening portion of the fan guard to the inlet hole of the first partition; and a guide rack coupleable with the first partition and configured to maintain the front cover inserted in an inner side of the fan guard by sliding from a side of the fan guard.

* * * * *